US005946777A

United States Patent [19]

Weatherall

[11] Patent Number: 5,946,777

[45] Date of Patent: Sep. 7, 1999

[54] BUTTON DEVICE

[76] Inventor: Darnell Weatherall, 2040 West Ave., Lancaster, Calif. 93536

[21] Appl. No.: 09/121,335

[22] Filed: Jul. 23, 1998

[51] Int. Cl.[6] ..... A44B 1/32

[52] U.S. Cl. ..... 24/109

[58] Field of Search ..... 24/109, 590, 593, 24/597, 591; 411/349

[56] References Cited

U.S. PATENT DOCUMENTS

| | | | |
|---|---|---|---|
| 480,352 | 8/1892 | Turner | 24/109 |
| 666,005 | 1/1901 | Ferguson | 24/109 |
| 1,502,899 | 7/1924 | Bernardini et al. | 24/109 |
| 1,518,540 | 12/1924 | Nelson | 24/109 |
| 1,595,053 | 8/1926 | Bellou, Jr. | 24/109 |
| 1,769,549 | 7/1930 | Scharer | 24/109 |
| 2,406,026 | 8/1946 | Morehouse | 24/109 |

*Primary Examiner*—James R. Brittain

[57] ABSTRACT

A button device for permitting interchanging of a variety of button heads on a garment to suit the needs of a user. The device includes a button head with an attachment shaft extended from the back side of the button head. The second end of the attachment shaft has an end protrusion having a pair of outwardly extending lock stubs. The button device also includes a tubular base having a lumen and open front and back ends. Each of the ends of the base has a radial end flange extending radially outwards therefrom. The lumen of the base has a pair of generally parallel elongate channels extending between the ends of the base. The second end of the attachment shaft is insertable through the lumen of the base from the opening of the front end of the base with the lock stubs inserted through the channels of the lumen of the base. The second end of said attachment shaft is extendable from the in the lumen through the opening of the back end of the base such that the protrusion of the second end of the attachment flange and the lock stubs extend from the back end of the base to hold the button head to the base.

9 Claims, 1 Drawing Sheet

BUTTON DEVICE

BACKGROUND OF THE INVENTION

1. Field of the Invention

The present invention relates to button devices and more particularly pertains to a new button device for permitting interchanging of a variety of button heads on a garment to suit the needs of a user.

2. Description of the Prior Art

The use of button devices is known in the prior art. More specifically, button devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art button devices include U.S. Pat. No. 5,189,762; U.S. Pat. No. 1,823,229; U.S. Pat. No. 2,129,356; U.S. Pat. No. 2,014,814; U.S. Pat. No. 5,542,157; and U.S. Pat. No. 5,379,888.

While these devices fulfill their respective, particular objectives and requirements, the aforementioned patents do not disclose a new button device. The inventive device includes a button head with an attachment shaft extended from the back side of the button head. The second end of the attachment shaft has an end protrusion having a pair of outwardly extending lock stubs. The button device also includes a tubular base having a lumen and open front and back ends. Each of the ends of the base has a radial end flange extending radially outwards therefrom. The lumen of the base has a pair of generally parallel elongate channels extending between the ends of the base. The second end of the attachment shaft is insertable through the lumen of the base from the opening of the front end of the base with the lock stubs inserted through the channels of the lumen of the base. The second end of said attachment shaft is extendable from the in the lumen through the opening of the back end of the base such that the protrusion of the second end of the attachment flange and the lock stubs extend from the back end of the base to hold the button head to the base.

In these respects, the button device according to the present invention substantially departs from the conventional concepts and designs of the prior art, and in so doing provides an apparatus primarily developed for the purpose of permitting interchanging of a variety of button heads on a garment to suit the needs of a user.

SUMMARY OF THE INVENTION

In view of the foregoing disadvantages inherent in the known types of button devices now present in the prior art, the present invention provides a new button device construction wherein the same can be utilized for permitting interchanging of a variety of button heads on a garment to suit the needs of a user.

The general purpose of the present invention, which will be described subsequently in greater detail, is to provide a new button device apparatus and method which has many of the advantages of the button devices mentioned heretofore and many novel features that result in a new button device which is not anticipated, rendered obvious, suggested, or even implied by any of the prior art button devices, either alone or in any combination thereof.

To attain this, the present invention generally comprises a button head with an attachment shaft extended from the back side of the button head. The second end of the attachment shaft has an end protrusion having a pair of outwardly extending lock stubs. The button device also includes a tubular base having a lumen and open front and back ends. Each of the ends of the base has a radial end flange extending radially outwards therefrom. The lumen of the base has a pair of generally parallel elongate channels extending between the ends of the base. The second end of the attachment shaft is insertable through the lumen of the base from the opening of the front end of the base with the lock stubs inserted through the channels of the lumen of the base. The second end of said attachment shaft is extendable from the in the lumen through the opening of the back end of the base such that the protrusion of the second end of the attachment flange and the lock stubs extend from the back end of the base to hold the button head to the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new button device apparatus and method which has many of the advantages of the button devices mentioned heretofore and many novel features that result in a new button device which is not anticipated, rendered obvious, suggested, or even implied by any of the prior art button devices, either alone or in any combination thereof.

It is another object of the present invention to provide a new button device which may be easily and efficiently manufactured and marketed.

It is a further object of the present invention to provide a new button device which is of a durable and reliable construction.

An even further object of the present invention is to provide a new button device which is susceptible of a low cost of manufacture with regard to both materials and labor, and which accordingly is then susceptible of low prices of sale to the consuming public, thereby making such button device economically available to the buying public.

Still yet another object of the present invention is to provide a new button device which provides in the apparatuses and methods of the prior art some of the advantages thereof, while simultaneously overcoming some of the disadvantages normally associated therewith.

Still another object of the present invention is to provide a new button device for permitting interchanging of a variety of button heads on a garment to suit the needs of a user.

Yet another object of the present invention is to provide a new button device which includes a button head with an attachment shaft extended from the back side of the button head. The second end of the attachment shaft has an end protrusion having a pair of outwardly extending lock stubs. The button device also includes a tubular base having a lumen and open front and back ends. Each of the ends of the base has a radial end flange extending radially outwards therefrom. The lumen of the base has a pair of generally parallel elongate channels extending between the ends of the base. The second end of the attachment shaft is insertable through the lumen of the base from the opening of the front end of the base with the lock stubs inserted through the channels of the lumen of the base. The second end of said attachment shaft is extendable from the in the lumen through the opening of the back end of the base such that the protrusion of the second end of the attachment flange and the lock stubs extend from the back end of the base to hold the button head to the base.

Still yet another object of the present invention is to provide a new button device that may be used to attach several different shapes, styles, and colors of button heads to a single garment.

Even still another object of the present invention is to provide a new button device that allows quick and easy detachment of the button head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
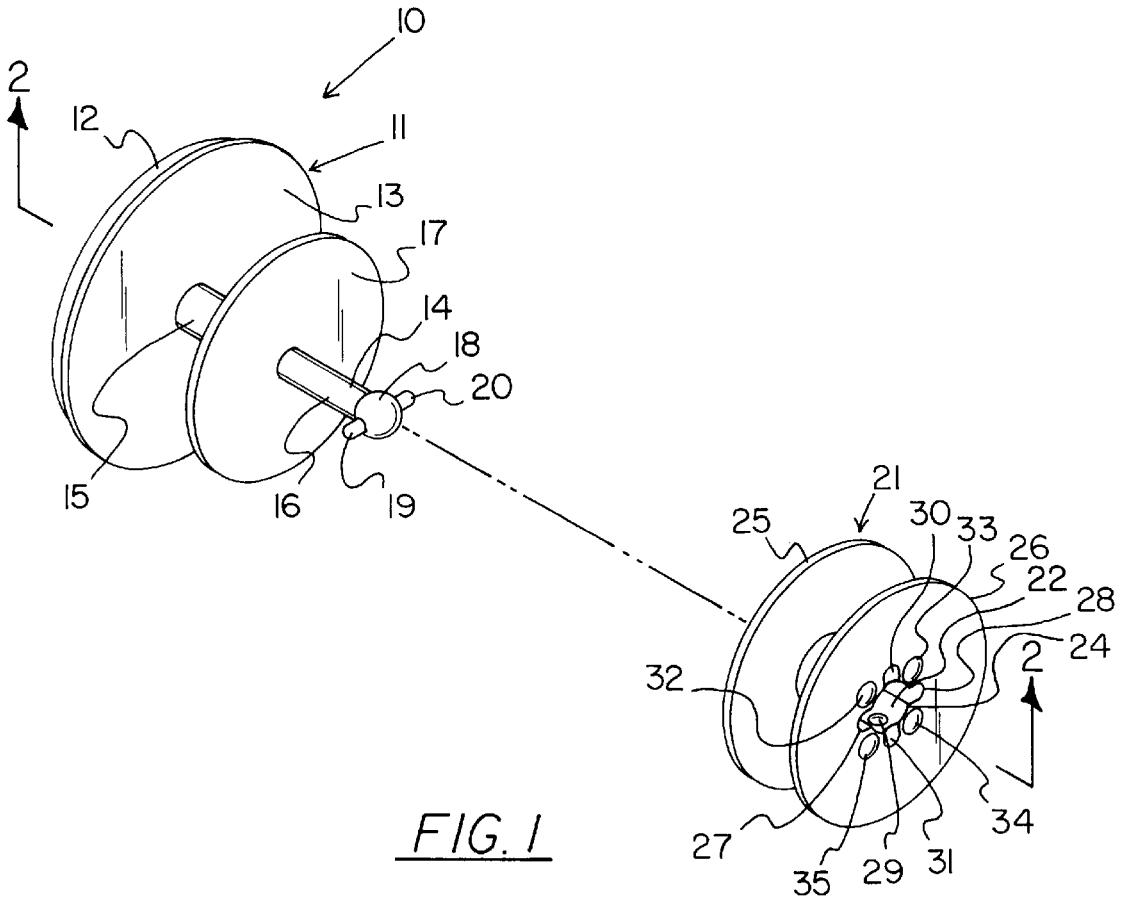
FIG. 1 is a schematic exploded perspective view of a new button device according to the present invention.
Figure 2:
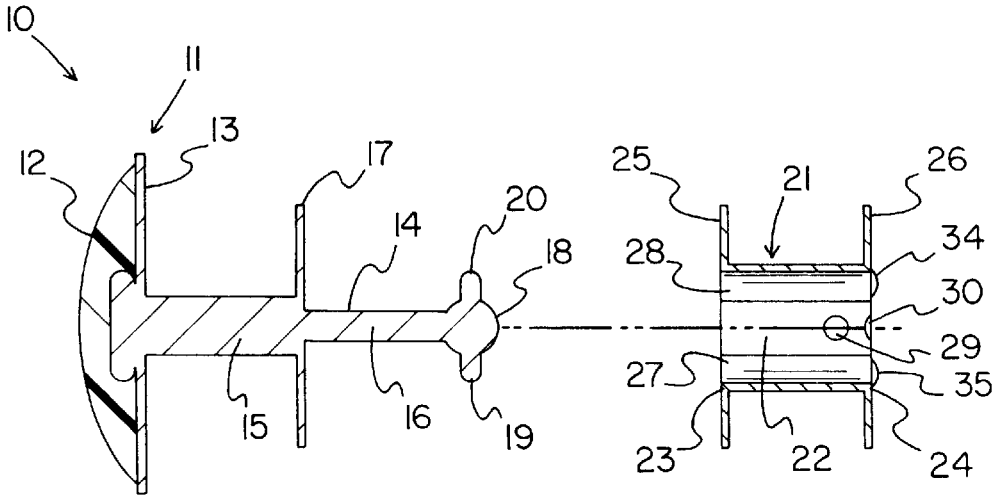
FIG. 2 is a schematic cross sectional view of the present invention as seen from line 2—2 of FIG. 1.

With reference now to the drawings, and in particular to FIGS. 1 through 2 thereof, a new button device embodying the principles and concepts of the present invention and generally designated by the reference numeral 10 will be described.

As best illustrated in FIGS. 1 through 2, the button device 10 generally comprises a button head 11 with an attachment shaft 14 extended from the back side 13 of the button head 11. The second end of the attachment shaft 14 has an end protrusion 18 having a pair of outwardly extending lock stubs 19,20. The button device also includes a tubular base 21 having a lumen 22 and open front and back ends 23,24. Each of the ends of the base 21 has a radial end flange 25,26 extending radially outwards therefrom. The lumen 22 of the base 21 has a pair of generally parallel elongate channels 27,28 extending between the ends of the base 21. The second end of the attachment shaft 14 is insertable through the lumen 22 of the base 21 from the opening of the front end 23 of the base 21 with the lock stubs 19,20 inserted through the channels 27,28 of the lumen 22 of the base 21. The second end of said attachment shaft 14 is extendable from the in the lumen 22 through the opening of the back end 24 of the base 21 such that the end protrusion 18 of the second end of the attachment flange and the lock stubs 19,20 extend from the back end 24 of the base 21 to hold the button head 11 to the base 21.

In closer detail, the button head 11 has front and back sides 12,13. The front side 12 of the button head 11 is formed to any shape, style, and color desired by a user. The back side 13 of the button head 11 is generally planar and has a center and an outer perimeter. Preferably, the back side 13 of the button head 11 is generally circular and has a diameter.

An elongate attachment shaft 14 is extended from the back side 13 of the button head 11. The attachment shaft 14 has opposite first and second ends, and a longitudinal axis extending between the first and second ends of the attachment shaft 14. Preferably, the attachment shaft 14 has a generally circular cross section taken substantially perpendicular to the longitudinal axis of the attachment shaft 14. The first end of the attachment shaft 14 is coupled to the back side 13 of the button head 11 so that the longitudinal axis of the attachment shaft 14 extends substantially perpendicular to the back side 13 of the button head 11. Preferably, the first end is positioned adjacent the center of the back side 13 of the button head 11 such that the center of the back side 13 of the button head 11 and the longitudinal axis of the attachment shaft 14 are coaxial.

In the preferred embodiment, the attachment shaft 14 has first and second portions 15,16. The first portion 15 of the attachment shaft 14 is positioned adjacent the first end of the attachment shaft 14 and the second portion 16 of the attachment shaft 14 is positioned adjacent the second end of the attachment shaft 14. Each of the portions of the attachment shaft 14 is generally cylindrical and has a diameter. Preferably, the diameter of the first portion 15 of the attachment shaft 14 is greater than the diameter of the second portion 16 of the attachment shaft 14.

The attachment shaft 14 has a generally circular spacer flange 17 extending radially outwards therefrom. The spacer flange 17 of the attachment shaft 14 is preferably interposed between the first and second portions 15,16 of the attachment shaft 14. Also preferably, the diameter of the spacer flange 17 is less than the diameter of the back side 13 of the button head 11. Ideally, the spacer flange 17 of the attachment flange is coaxial with the back side 13 of the button head 11 so that the spacer flange 17 is concentrically aligned with the back side 13 of the button head 11.

The second end of the attachment shaft 14 has an end protrusion 18. The end protrusion 18 is generally spherical and has an axis and a diameter. The axis of the end protrusion 18 is coaxial with the longitudinal axis of the attachment shaft 14. Ideally, the diameter of the end protrusion 18 is generally equal to the diameter of the first portion 15 of the attachment shaft 14. The end protrusion 18 has a pair of diametrically outwardly extending lock stubs 19,20 with the lengths of the lock stubs 19,20 extending substantially perpendicular to the longitudinal axis of the attachment shaft 14.

The tubular base 21 has a lumen 22 and front and back ends 23,24. Each of the ends of the base 21 has a periphery defining an opening into the lumen 22 of the base 21. The base 21 has a longitudinal axis extending between the ends of the base 21. Preferably, the base 21 has a generally circular cross-section taken substantially perpendicular to the longitudinal axis of the base 21. Each of the ends 23,24 of the base 21 has a radial end flange 25,26 extending radially outwards therefrom. The end flanges 25,26 are preferably generally circular and coaxial with the longitudinal axis of the base 21 with the end flanges 25,26 each lying in planes generally parallel to each other and perpendicular to the longitudinal axis of the base 21. The lumen 22 of the base 21 has a pair of generally parallel diametric elongate channels 27,28 extending between the ends of the base 21. Preferably, the base 21 also has a generally circular inner protrusion 29 extending inwards into the lumen 22. The inner protrusion 29 is positioned adjacent the end flange 26 of the back end 24 of the base 21 and is positioned between the channels 27,28.

Preferably, the end flange 26 of the back end 24 of the base 21 has a pair of diametric grooves 30,31 extending radially outwards from the periphery of the opening of the back end 24 of the base 21. The grooves 30,31 are extended along a line generally perpendicular to a line extended across the channels 27,28 of the lumen 22 of the base 21. The end flange 26 of the back end 24 of the base 21 has preferably a plurality of spaced apart generally circular holding protrusions 32,33,34,35 extending therefrom. Each of the holding protrusions 32,33,34,35 is positioned adjacent the periphery of the opening of the back end 24 of the base 21 with each of the holding protrusions 32,33,34,35 located between a groove and a channel around the periphery of the opening of the back end 24 of the base 21.

In use, the button device is designed for attachment to a garment so that a user may interchange various button heads to suit their needs on the same garment. The base 21 is designed for extending through the material of an article of clothing with the end flanges 25,26 designed for positioning on either side of the material so that the material is interposed between the end flanges 25,26. In use, the second end of the attachment shaft 14 is insertable through the lumen 22 of the base 21 from the opening of the front end 23 of the base 21 through the opening of the back end 24 of the base 21 such that the end protrusion 18 of the second end of the attachment flange and the lock stubs 19,20 extend from the back end 24 of the base 21. The attachment shaft is extendable through the lumen of the base until the spacer flange 17 abuts the end flange 25 of the front end 23 of the base 21. As the attachment shaft is inserted into the lumen, the lock stubs 19,20 are slid through the channels 27,28 of the lumen 22 of the base 21. The end protrusion 18 of the second end of the attachment shaft 14 is slidable over the inner protrusion 29 when the attachment shaft 14 is slid through the lumen 22 of the base 21 in use, the attachment shaft 14 is rotatable in the lumen 22 of the base 21 when the protrusion and the lock stubs 19,20 of the second end of the attachment flange are extended from the back end 24 of the base 21. This permits rotation of the lock stubs 19,20 from a position parallel to the channels 27,28 over the holding protrusions 32,33,34,35 to a position resting in the grooves 30,31 to hold the head member securely to the base 21. To detach the button head from the base, the attachment shaft is rotated to align the stubs with the channels so that the attachment shaft may be pulled out of the lumen of the base.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A button device for attachment to a garment, said button device comprising;

a button head;

an elongate attachment shaft being outwardly extended from said back side of said button head, said attachment shaft having opposite first and second ends;

said first end of said attachment shaft being coupled to said back side of said button head;

said attachment shaft having a spacer flange extending radially outwards therefrom;

said second end of said attachment shaft having an end protrusion;

said end protrusion having a pair of outwardly extending lock stubs;

a tubular base having a lumen and open front and back ends;

each of said ends of said base having a radial end flange extending radially outwards therefrom;

said lumen of said base having a pair of channels extending between said ends of said base;

said second end of said attachment shaft being inserted through said lumen of said base from said opening of said front end of said base through said opening of said back end of said base such that said protrusion of said second end of said attachment flange and said lock stubs extend from said back end of said base;

said lock stubs being slidable through said channels of said lumen of said base when said second end of said attachment shaft is inserted through said lumen of said base; and wherein said base has an inner protrusion extending inwards into said lumen.

2. The button device of claim 1, wherein said attachment shaft has first and second portions, said first portion of said attachment shaft being positioned adjacent said first end of said attachment shaft, said second portion of said attachment shaft being positioned adjacent said second end of said attachment shaft, said spacer flange of said attachment shaft being interposed between said first and second portions of said attachment shaft.

3. The button device of claim 2, wherein each of said portions of said attachment shaft is generally cylindrical and has a diameter, said diameter of said first portion of said attachment shaft being greater than said diameter of said second portion of said attachment shaft.

4. The button device of claim 1, wherein said end flange of said back end of said base has a pair of grooves extending radially outwards from said periphery of said opening of said back end of said base.

5. The button device of claim 1, wherein said end flange of said back end of said base has a plurality of spaced apart holding protrusions extending therefrom, each of said holding protrusions being positioned adjacent said periphery of said opening of said back end of said base, each of said holding protrusions being located between a groove and a channel around the periphery of said opening of said back end of said base.

6. The button device of claim 1, wherein said inner protrusion is positioned adjacent said end flange of said back end of said base.

7. The button device of claim 1, wherein said inner protrusion is positioned between said channels of said lumen of said base.

8. A button device, comprising:

a button head having front and back sides, said back side of said button head having a center;

an elongate attachment shaft being extended from said back side of said button head, said attachment shaft having opposite first and second ends, and a longitudinal axis extending between said first and second ends of said attachment shaft;

said first end of said attachment shaft being coupled to said back side of said button head;

said attachment shaft having a spacer flange extending radially outwards therefrom;

said second end of said attachment shaft having an end protrusion, said end protrusion being generally spherical and having an axis and a diameter, said axis of said end protrusion being coaxial with said longitudinal axis of said attachment shaft;

said end protrusion having a pair of outwardly extending lock stubs, each of said lock stubs having a length;

a tubular base having a lumen and front and back ends, each of said ends of said base having a periphery defining an opening into said lumen of said base, said base having a longitudinal axis extending between said ends of said base;

each of said ends of said base having a radial end flange extending radially outwards therefrom;

said lumen of said base having a pair of generally parallel elongate channels extending between said ends of said base;

said second end of said attachment shaft being insertable through said lumen of said base from said opening of said front end of said base through said opening of said back end of said base such that said protrusion of said second end of said attachment flange and said lock stubs extend from said back end of said base;

said lock stubs being slidable through said channels of said lumen of said base when said second end of said attachment shaft is inserted through said lumen of said base; and wherein said base has a generally circular inner protrusion extending inwards into said lumen, said inner protrusion being positioned adjacent said end flange of said back end of said base, said inner protrusion being positioned between said channels of said lumen of said base.

9. A button device for attachment to a garment, said button device comprising;

a button head having front and back sides, said back side of said button head being generally planar and having a center, an outer perimeter, said back side of said button head being generally circular and having a diameter;

an elongate attachment shaft being extended from said back side of said button head, said attachment shaft having opposite first and second ends, and a longitudinal axis extending between said first and second ends of said attachment shaft;

said attachment shaft having a generally circular cross section taken substantially perpendicular to said longitudinal axis of said attachment shaft;

said first end of said attachment shaft being coupled to said back side of said button head;

said longitudinal axis of said attachment shaft being extended substantially perpendicular to said back side of said button head;

said first end being positioned adjacent said center of said back side of said button head such that said center of said back side of said button head and said longitudinal axis of said attachment shaft are coaxial;

said attachment shaft having first and second portions, said first portion of said attachment shaft being positioned adjacent said first end of said attachment shaft, said second portion of said attachment shaft being positioned adjacent said second end of said attachment shaft;

each of said portions of said attachment shaft being generally cylindrical and having a diameter, said diameter of said first portion of said attachment shaft being greater than said diameter of said second portion of said attachment shaft;

said attachment shaft having a spacer flange extending radially outwards therefrom, said spacer flange of said attachment shaft being interposed between said first and second portions of said attachment shaft;

said spacer flange of said attachment shaft being generally circular and having a diameter, said diameter of said spacer flange being less than said diameter of said back side of said button head, said spacer flange of said attachment flange being coaxial with said back side of said button head;

said second end of said attachment shaft having an end protrusion, said end protrusion being generally spherical and having an axis and a diameter, said axis of said end protrusion being coaxial with said longitudinal axis of said attachment shaft;

said end protrusion having a pair of diametrically outwardly extending lock stubs, each of said lock stubs having a length, said lengths of said lock stubs being extended substantially perpendicular to said longitudinal axis of said attachment shaft;

a tubular base having a lumen and front and back ends, each of said ends of said base having a periphery defining an opening into said lumen of said base, said base having a longitudinal axis extending between said ends of said base, said base having a generally circular cross-section taken substantially perpendicular to said longitudinal axis of said base;

each of said ends of said base having a radial end flange extending radially outwards therefrom, each of said end flanges being generally circular and coaxial with said longitudinal axis of said base, said end flanges being generally parallel to each other and perpendicular to said longitudinal axis of said base;

said lumen of said base having a pair of generally parallel diametric elongate channels extending between said ends of said base;

said base having a generally circular inner protrusion extending inwards into said lumen, said inner protrusion being positioned adjacent said end flange of said back end of said base, said inner protrusion being positioned between said channels of said lumen of said base;

said end flange of said back end of said base having a pair of diametric grooves extending outwards from said periphery of said opening of said back end of said base, said grooves being extended along a line generally perpendicular to a line extended across said channels of said lumen of said base;

said end flange of said back end of said base having a plurality of spaced apart holding protrusions extending therefrom, each of said holding protrusions being positioned adjacent said periphery of said opening of said back end of said base, each of said holding protrusions being located between a groove and a channel around the periphery of said opening of said back end of said base;

said second end of said attachment shaft being insertable through said lumen of said base from said opening of said front end of said base through said opening of said back end of said base such that said protrusion of said second end of said attachment flange and said lock stubs extend from said back end of said base;

said lock stubs being slidable through said channels of said lumen of said base when said second end of said attachment shaft is inserted through said lumen of said base; and said attachment shaft being rotatable in said lumen of said base when said protrusion and said lock stubs of said second end of said attachment flange are extended from said back end of said base.

* * * * *